US006776377B1

(12) United States Patent
Watkins

(10) Patent No.: US 6,776,377 B1
(45) Date of Patent: Aug. 17, 2004

(54) RAILWAY CROSSING GATE ASSEMBLY, COMPONENTS THEREFOR AND METHODS OF MAKING THE SAME

(76) Inventor: Craig A. Watkins, 1473 E. Trafficway, Springfield, MO (US) 65802

( * ) Notice: Subject to any disclaimer, the term of this patent is extended or adjusted under 35 U.S.C. 154(b) by 0 days.

(21) Appl. No.: 10/299,122

(22) Filed: Nov. 19, 2002

(51) Int. Cl.[7] ..... B61L 23/00
(52) U.S. Cl. ..... 246/111
(58) Field of Search ..... 246/111, 112, 246/113, 114 R, 257, 259, 261

(56) References Cited

U.S. PATENT DOCUMENTS 494,390 A 3/1893 Smith
2,874,493 A 2/1959 Mandel
3,994,457 A 11/1976 Teasel
4,090,685 A 5/1978 Pappas
4,531,325 A 7/1985 Phillips
4,655,002 A 4/1987 Everson
4,666,108 A 5/1987 Fox
4,784,356 A 11/1988 Fox
4,811,516 A 3/1989 Anderson
4,897,960 A 2/1990 Barvinek et al.
5,469,660 A 11/1995 Tamenne
5,671,563 A 9/1997 Marcum
6,142,426 A * 11/2000 Zaro et al. ..... 246/125
6,189,839 B1 * 2/2001 Lemieux ..... 246/293
6,267,332 B1 * 7/2001 Almblad ..... 246/294

* cited by examiner

*Primary Examiner*—S. Joseph Morano
*Assistant Examiner*—Robert J. McCarry, Jr.
(74) *Attorney, Agent, or Firm*—Richard L. Marsh

(57) ABSTRACT

A crossing gate arm comprises at least two generally tubular members having one end engagable with a portion of a crossing gate assembly wherein the opposite free end of the crossing gate arm has a part of one tubular member removed to impart flexibility to the free end.

19 Claims, 5 Drawing Sheets

RAILWAY CROSSING GATE ASSEMBLY, COMPONENTS THEREFOR AND METHODS OF MAKING THE SAME

BACKGROUND OF THE INVENTION

1. Field of the Invention

This invention relates to a crossing gate arm assembly which comprises generally tubular members wherein one member has a part thereof removed to impart flexibility to its free end.

2. Prior Art Statement

It is known to provide a solid crossing gate arm assembly having an end section telescope from a main arm for passing under trolley wires. For instance, see the U.S. Pat. No. 494,390 issued on Mar. 28, 1893 to Henry Smith. The end section of the Smith arm is not flexible and the length and weight of the entire assembly is apparently great enough to require a midway support pole. Thus, there is a need for a lightweight crossing gate arm assembly having a flexible end section.

It is also known to provide a flexible plastic pole for use as a crossing guard arm. For instance, see the U.S. Pat. No. 2,874,493, to Henri Mandel issued on Feb. 24, 1959. The flexible pole of Mandel is useful only for short crossing arms of less than eight feet as the weight thereof at greater lengths is sufficient to cause the end of the pole to drape to the ground. Thus, there is a need for an extendable length, lightweight crossing gate arm section having a flexible end.

It is further known to provide a crossing gate comprising a plurality of rigid identical gate modules secured together in an end to end manner, each gate section having a male end and female end. For instance, see U.S. Pat. No. 3,994,457 issued on Nov. 30, 1976 to William Teasel. The identical sections must, of necessity, be rigid and therefore no flexible end is provided. Furthermore, the sections are made of thick walled injection molded polycarbonate and thus the weight of an elongated gate arm is quite substantial. Thus, there is a need for a lightweight, extended length crossing gate arm assembly of substantially equal length members wherein an end member has a flexible free end.

Additionally, it is known to provide a grade crossing assembly comprising an elongated tubular aluminum gate arm provided with alternate stripes of different colors of suitable retro-reflective material and three electrical lamps, one of which is continuously illuminated while the other two are intermittently flashed. For instance, see the U.S. Pat. No. 4,090,685 issued on May 23, 1987 to Spiro Pappas. This tubular aluminum gate arm is rigid in construction and thus there is a need for a tubular gate arm having a flexible free end.

Railway crossing gate assemblies comprising telescoping gate sections having gate lights mounted at any position on the gate arm are available from L&W Industries, a corporation headquartered in Springfield, Mo., or from SafeTran, a corporation doing business from Kentucky and California, however, the telescoping gate sections are heavy rigid box beams. Typically, this construction is common in the industry wherein the length of each section is sixteen feet or more requiring shipment by common carrier. Hence, there is a need for a gate arm assembly having a flexible free end wherein the entire gate arm is lightweight and can be shipped by rapid transit carriers.

Also known in the art is a hinged vehicle gate arm having a first section mounted to an automatic vehicle gate operating mechanism and a second arm attached to the first arm section by a hinge assembly. For instance, see the U.S. Pat. No. 4,531,325 issued on Jul. 30, 1985 to David Phillips. A slanting pivot hinge is provided in U.S. Pat. No. 4,655,002 issued on Apr. 7, 1987 to Clifford Everson for causing the end section to rotate upwardly and toward the railway when impacted by a vehicle. The hinged arms described in these two patents basically pivot from the mounting mechanism alongside the roadway and hence are limited to short gate arm sections. Thus, there is a need for an elongated, lightweight crossing gate arm section with a flexible free end.

It is further known in the art to provide a crossing arm arrangement having a signal relay switch circuitry comprising an extensible crossing arm, a plurality of electrically actuated gate lamp fastening means for fastening a gate lamp to any of a plurality of selected locations along the length of the crossing arm and an extensible cable means for electrically connecting a gate lamp to the relay switch circuitry. For instance, see the U.S. Pat. Nos. 4,666,108 and 4,784,356B1 issued on May 19, 1987 and Jan. 24, 1995 respectively, to David Fox. The extensible crossing arm is comprised of rigid sections and thus there is a need for a lightweight, extensible crossing arm having a flexible free end.

It is also known to provide a movable gate arm comprising a stiffening member made of wood encased in a sleeve of extruded polycarbonate. For instance, see the U.S. Pat. No. 4,811,516 issued on Mar. 14, 1989 to Howard Anderson. This gate arm is a single piece and is not flexible. A multiple piece vehicle control arm having a core element and a flexible shell with the core disposed through at least a portion thereof and adapted to breakaway at a mid point is described in U.S. Pat. No. 5,671,563 issued on Sep. 30, 1997 to Alfred Marcum. Though the gate arm has a flexible shell, the core is solid and hence the weight of the gate arm is substantial. Thus there is a need for a lightweight gate arm having a flexible free end.

Still further known is to provide a crossing gate arm assembly which when struck with a vehicle, the gate arm pivots in a horizontal plane about a vertical pivot. For instance, see the U.S. Pat. No. 4,897,960 issued on Feb. 6, 1990 to Barvinek, et al., or the U.S. Pat. No. 5,469,660 issued on Nov. 28, 1995 to Harry Tamenne. In these two patents, the entire arm moves into the path of a train and hence may be damaged by the train before returning to its guarding position across the roadway. Thus, a lightweight gate arm having a flexible free end is needed.

Finally, another known gate arm comprises a two quadrant gate system having a means for extending its length to restrict traffic for each of the two directions of the roadway wherein each gate of the two quadrant gate system may be laterally flexible to allow a vehicle to pass through a lowered gate as a way of escaping an existing safety hazard without breaking the gate or damaging the vehicle. For instance, see the U.S. Pat. No. 6,267,332 issued on Jul. 31, 2001 to Robert Almblad. The entire gate assembly is laterally flexible which is unstable in most environs where a wind load is imparted to the arm causing the flexible portion to fail from vibration and thus there is a need for a lightweight gate arm which has a flexible end section.

SUMMARY OF THE INVENTION

It is an object of this invention to provide a crossing gate arm assembly comprising at least two generally rectangular tubular members wherein an outboard or end tubular member has one end thereof engagable with a portion of another generally tubular member of the crossing gate assembly wherein the opposite end of the end tubular member has a part of the tubular member removed to impart flexibility to the opposite end.

It is another object of this invention to provide a crossing gate arm assembly comprising at least two generally tubular members wherein an end or outboard tubular member has one end thereof engagable with a portion of a crossing gate assembly and an opposite end having a part of the tubular member removed to impart flexibility to the opposite end wherein the end tubular member comprises two U-shaped channels wherein the legs of a smaller of the U-shaped channels are confined within the legs of a larger of the U-shaped channels wherein the smaller of the U-shaped channels may move longitudinally with respect to the larger of the U-shaped channels. The U-shaped channels are preferably frictionally affixed together.

A feature of this invention is to provide a crossing gate end arm section for a crossing gate arm assembly wherein the end gate arm section comprises two U-shaped channels joined together into a box beam with a part of an end of the side edges of the two U-shaped channels removed to impart flexibility therein wherein one of the U-shaped channels has a slot disposed through a remaining segment of the free end and the other of the U-shaped channels has a hole disposed through a remaining segment of the free end with the hole aligned with the slot. A fastener is preferably loosely placed in the slot and the hole to bring the remaining segments of the U-shaped channels into close proximity to allow the free ends to be flexible in a direction transverse to the plane of movement of the crossing gate arm assembly.

Another feature of this invention is to provide a crossing gate arm assembly rotatably mounted on a crossing gate operating mechanism, the crossing gate operating mechanism moving the crossing gate arm assembly in a plane of movement from a raised, substantially vertical storage position to a lowered substantially horizontal guarding position wherein the crossing gate arm assembly comprises a outboard or end tubular member, such as a closed box beam, the outboard or end member having one end telescopically engagable with at least a portion of at least one other generally tubular member, the outboard or end tubular member having a part of the narrow side edges of the box beam removed from a free end opposite the one end of the outboard or end tubular member to impart flexibility to the free end to prevent damage to the crossing gate arm section when the free end is impacted by an automobile attempting to circumvent the guarding position of the crossing gate arm assembly.

It is a major attribute of this invention to provide a crossing gate arm assembly comprising at least three generally tubular members wherein the tubular members are substantially equal in length to permit storage of the crossing gate arm assembly in a minimum size wayside control house or to permit cartage of the crossing gate arm assembly on a pickup overhead rack or transport within the bed of a standard pickup truck.

A significant characteristic of this invention is to provide a crossing gate arm assembly comprising at least three generally tubular members wherein the tubular members are approximately eight feet six inches in length.

An important feature of this invention is to provide a crossing gate arm assembly comprising at least three generally tubular members wherein an end tubular member has a weight of approximately 6.5 pounds thus greatly reducing the weight of the end member and hence the entire gate arm assembly thus allowing a fully extended crossing gate arm to come to rest about 12 inches higher above the roadway than prior art gate arm assemblies and also providing a reduced rotational mass thus reducing wear upon the operating mechanism raising the gate arm assembly.

Yet another important feature of this invention is to produce a crossing gate arm assembly comprising four generally tubular members wherein the weight of the end tubular member is reduced thus reducing the entire shipping weight of the crossing gate arm assembly allowing shipment of the crossing gate arm assembly by rapid transit carriers.

Another feature of this invention is to provide a for a crossing gate arm assembly having one crossing gate arm section comprising a generally tubular outboard or end member wherein the outboard or end member has one end telescopically engagable with at least a portion of at least one other generally tubular member and wherein the gate arm section comprises two U-shaped channels joined together into a box beam, the crossing gate arm section having at least one warning light assembly removably affixed to the outboard or end tubular member and at least one warning light assembly removably affixed to the one other tubular member. Alternately, a part of the narrow side edges of the box beam is removed from a free end opposite the one end wherein the one warning light affixed to the outboard or end tubular member is mounted within the remaining segment of the free end. Preferably, the warning light assembly has reversible connectors on opposed sides thereof for establishing one of a plurality of light flashing sequences to the warning lights mounted to the crossing gate arm assembly, however, it is also within the scope of this invention to internally wire each warning light assembly to alter the light flashing sequences of the warning lights.

Another significant object of this invention is to provide a crossing gate arm assembly rotatably mounted on a crossing gate operating mechanism, the crossing gate operating mechanism moving the crossing gate arm assembly in a plane of movement from a raised storage position to a substantially horizontal guarding position, the crossing gate arm assembly comprising generally tubular members of substantially equal length but progressively smaller cross section wherein an outboard or end tubular member has one end telescopically engaged within at least a portion of a tubular insulating member, the insulating member having a first end telescopically engaged within at least a portion of an inboard or mounting tubular member wherein the outboard tubular member has a flexible free end and wherein the outboard, insulating and mounting tubular members are longitudinally extendable and affixable together in any length from the length of one of the members plus the free end to a fully extended length equal to the sum of the lengths of the end, insulating and mounting tubular members.

Finally, it is an object of this invention to provide a gate arm section which is torsionally flexible for increased durability in windy conditions.

DESCRIPTION OF THE PREFERRED EMBODIMENTS

While the various features of this invention are hereinafter described and illustrated as a crossing gate arm assembly comprising at least two generally tubular members having one end of an outboard tubular member engagable with a portion of a crossing gate assembly and an opposite end of the outboard member having a part of the tubular member removed to impart flexibility to the opposite end it is to be understood that the various features of this invention can be used singly or in various combinations thereof for a crossing gate arm assembly as can hereinafter be appreciated from a reading of the following description.

Figure 1:
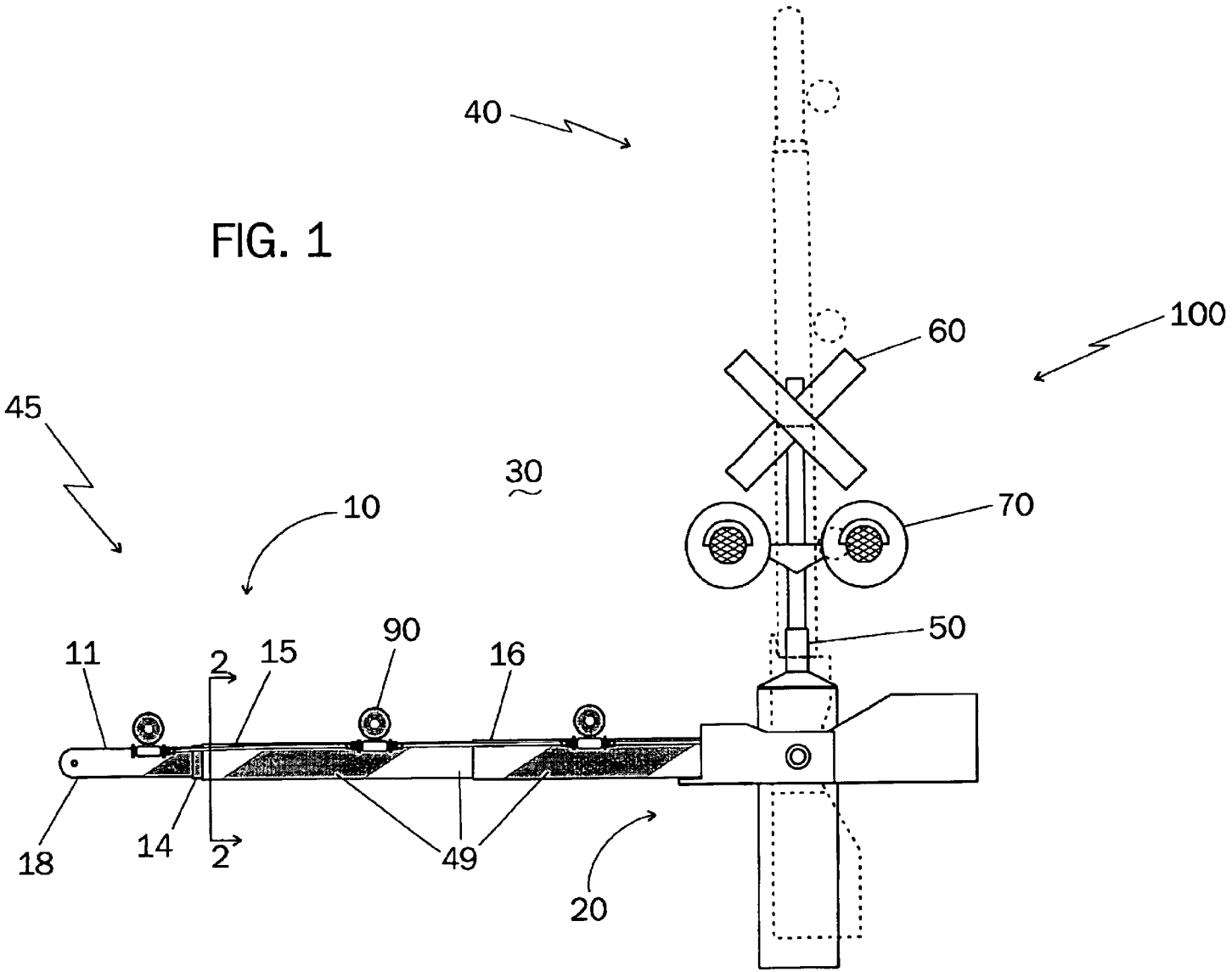
FIG. 1 is a frontal plan view of a wayside signal having the preferred embodiment of the crossing gate arm assembly of this invention mounted thereon.

Referring now to FIG. 1, a crossing gate arm assembly generally shown by the numeral 10 is rotatably mounted on a crossing gate operating mechanism 20 wherein crossing gate arm assembly 10, crossing gate operating mechanism 20, mounting post 50 having a crossbar 60 and signal lights 70 disposed thereon comprise a wayside signal 100 used at the intersection of a railroad and a flat surface roadway such as an automotive highway as is well known. Crossing gate operating mechanism 20 moves crossing gate arm assembly 10 in a plane 30 of movement from a raised, substantially vertical storage position 40, shown in dashed lines, to a lowered, substantially horizontal guarding position 45 shown in solid lines. Crossing gate arm assembly 10 comprises a generally tubular outboard or end member 11 having one end 12 telescopically engagable with at least a portion 13 of at least one other generally tubular member 14–16, outboard member 11 having a part 17 of a free end 18 opposite one end 12 removed to impart flexibility to free end 18. Free end 18 is made flexible to prevent damage to crossing gate arm assembly 10 when free end 18 is impacted by an automobile attempting to circumvent guarding position 45 of crossing gate arm assembly 10. It has been found by the instant inventor that a variety of crossing gate arm assemblies 10 may be constructed of generally tubular members 11, 14–16 which are substantially equal in length thus providing additional benefits as will be hereinafter fully explained. Crossing gate arm assembly 10 may comprise only outboard or end member 11 and a tubular insulating member 14 wherein insulating member 14 is inserted into a first end 26 of a short tubular section 25 of the same cross sectional size as alternate mounting member 15 with short tubular section 25 affixed to crossing gate operating mechanism 20 with bolts through mounting holes 27 in an end 28 opposite first end 26. When so configured, tubular end member 11 may be affixed to insulating member 14 and short tubular section 25 to provide crossing gate arm assembly 10 in any length from about 10 feet to about 17½ feet. Insulating member 14 electrically insulates end member 11 from crossing gate operating mechanism 20 and thus is usually extruded resin filled fiberglass but may be any insulating material having sufficient strength to be cantilevered from crossing gate operating mechanism 20 to support end tubular member 11. Alternately, for spanning across one direction of a wide two lane or narrow four lane road crossing, a first end 19 of a insulating member 14 may be telescopically received in an end portion 21 of a alternate mounting member 15 wherein alternate mounting member 15 has a base end 22 affixed directly to crossing gate operating mechanism 20 to provide for a longer crossing gate arm assembly 10 from over 17 feet to at least 23 feet. In another configuration, short tubular section 25 may also be used between insulating member 14 and primary tubular member 16 to provide for a length of crossing gate arm assembly 10 from about 19 feet to about 25 feet as short tubular section 25 is typically about 3 feet in length. Additionally, as can be observed in FIG. 4, by telescopically placing base end 22 of alternate mounting member 15 into the open end 23 of a primary tubular member 16 wherein alternate mounting member 15 has had tubular insulating member 14 placed therein with tubular end member 11 extending from portion 13 thereof, crossing gate arm assembly 10 may be extended to a length from over 23 feet to about 32½ feet for spanning across one direction of traffic of a wider four lane highway crossing or an urban four lane street having a center turn lane. Crossing gate arm assembly 10, thus can be assembled in a variety of configurations for use at various crossing grades throughout the country.

In FIG. 1, tubular members 11, 14–16 may all be box beams of different cross sectional size but generally of the same shape, each successive smaller tubular member 11, 14–15 telescopically received into the interior of the next larger tubular member 14–16. As all tubular members 11, 14–16 are preferably of the same length, approximately 8 feet 6 inches, a complete crossing gate arm assembly 10 may be shipped in a relatively small shipping container by telescopically assembling all members 11, 14–16 together, placing the completely telescoped crossing gate arm assembly 10 into a 6 inch high by 2½ inch wide by 8 feet 6 inches in length shipping container. Preferably, however, as tubular members 11, 14–16 are made to be close fitting as can be readily observed in FIG. 2, it has been found by the inventor that shipment is best effected by placing short tubular section 25 and insulating member 14 within tubular member 16, this sub-assembly placed alongside a second sub-assembly of tubular end member 11 placed within the confines of alternate mounting member 15. The two sub-assemblies are then packed side by side in a 6 inch high by 5 inch wide by 8 feet 6 inch long shipping container. The sub-assemblies, including the shipping container, have a weight of about 55 pounds and hence may be shipped by rapid carrier such as United Parcel Service, Federal Express, D.H.L. and the like whereas common gate arms of 16 feet and more that 80 pounds must be shipped by common carrier. It is readily apparent then, that crossing gate arm assembly 10 of the instant invention may be placed in service much sooner than the prior art gate arms as overnight shipping for crossing gate arm assembly 10 is available whereas shipment of prior art gate arms by common carrier often takes two weeks or more. Furthermore, since crossing gate arm assembly 10 is collapsed into a shipping container of less than nine feet in length, crossing gate arm assembly 10 of this invention may be stored completely within a minimum size wayside control house of 4×6×8 feet by placing the shipping container with crossing gate arm assembly 10 confined therein diagonally across the back wall or either side wall of the wayside control house. The shorter lengths of tubular members 11, 14–16 of crossing gate arm assembly 10 of this invention also permits cartage of crossing gate arm assembly 10 on an overhead rack of a pickup truck as well as transport within the bed of a standard pickup truck as the shipping container with crossing gate arm assembly 10 confined therein may readily be placed diagonally across the bed of the pickup truck. Though members 11, 14–16 are preferably of the same length, any one or all of the members 11, 14–16 made of a shorter length is contemplated by the instant inventor and thus fully within the scope of this invention.

Figure 3:
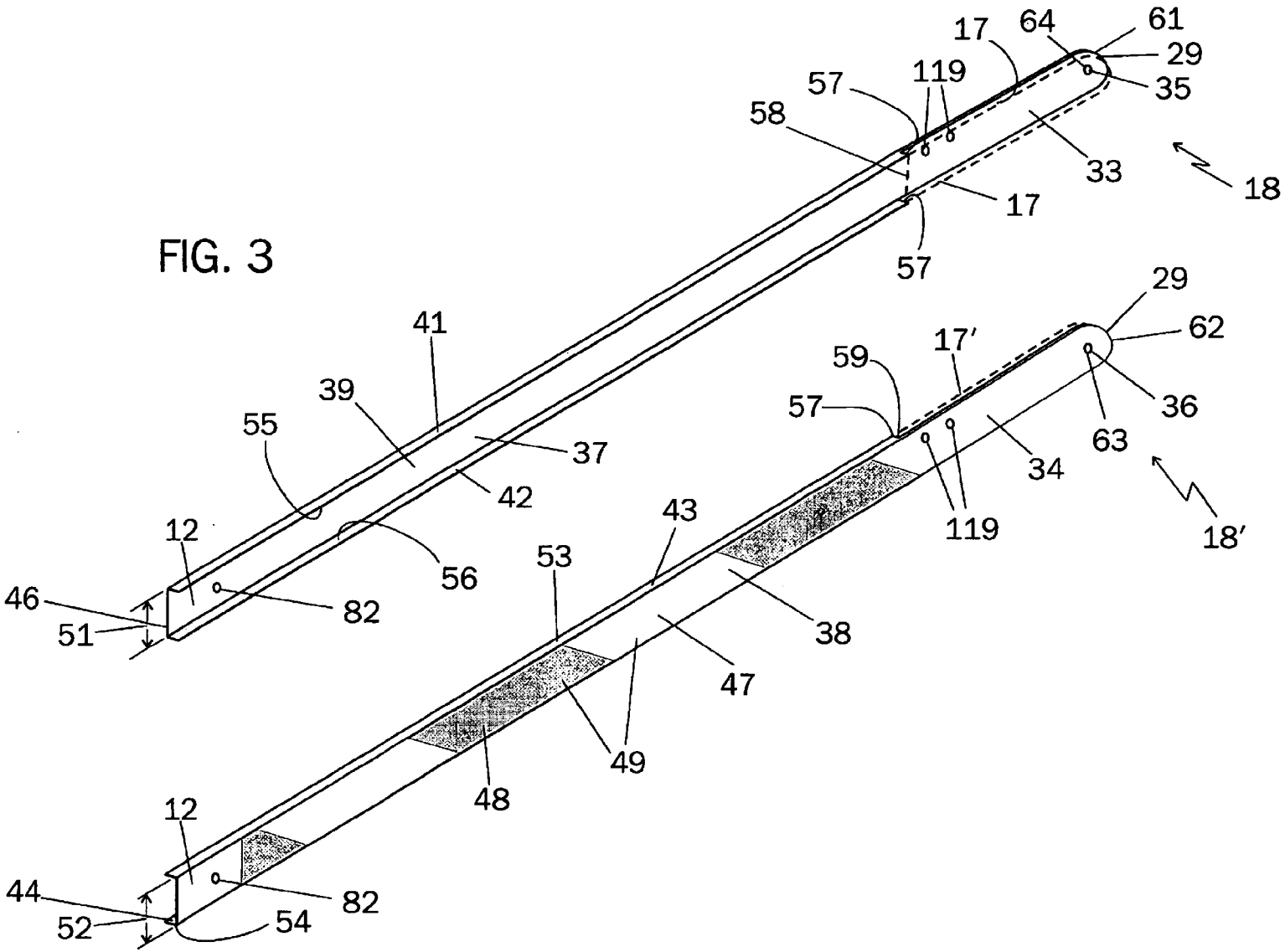
FIG. 3 is a greatly enlarged, exploded perspective view of the end tubular member of the preferred embodiment of FIG. 1.
Figure 4:
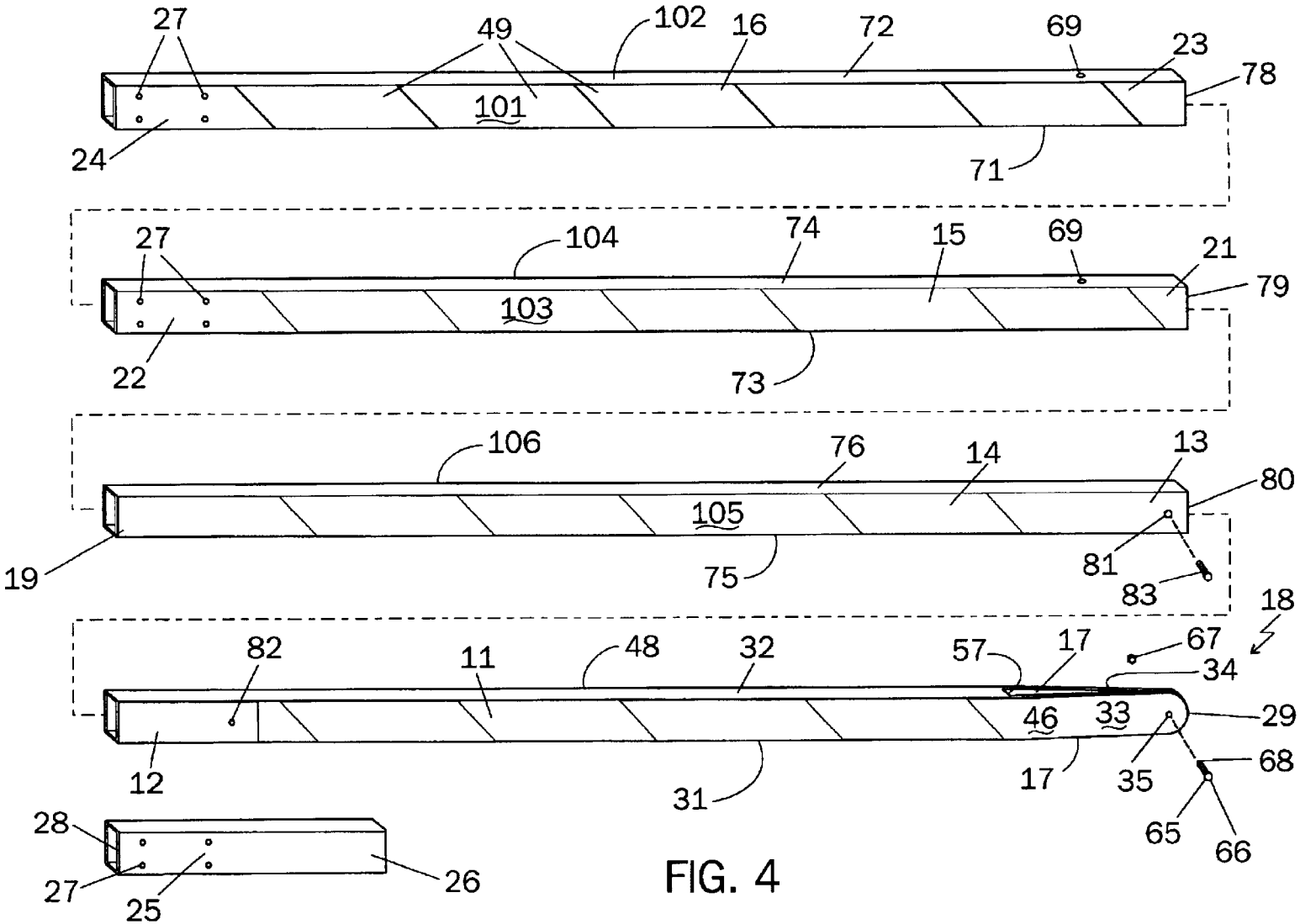
FIG. 4 is an exploded perspective view of the tubular members of the crossing gate arm assembly of the preferred embodiment.

Referring now to the embodiment in FIG. 4, tubular end member 11 is rectangular in cross section and is a closed box beam with free end 18 of tubular end member 11 having part 17 removed from both narrow side edges 31, 32 for a distance of about 18 inches inwardly from free end 18 to provide for flexibility to free end 18. Though a greater or lesser length may be removed from both narrow side edges 31, 32, it has been found that 18 inches provides sufficient lateral flexibility for the purposes set forth in this invention. As the entirety of narrow side edges 31, 32 is removed at free end 18, remaining segments 33, 34 may readily move in a plane transverse to the length and height of tubular end member 11 thus making free end 18 flexible in a direction transverse to plane 30 of movement of crossing gate arm assembly 10. In FIG. 4, remaining segments 33, 34 are shown spaced apart at cut 57 as would occur upon removal of parts 17, however, remaining segments 33, 34 are joined together prior to placing crossing gate arm assembly 10 into service by placing a fastener 65 loosely through slot 35 in remaining segment 33 and through a hole 36 (see FIG. 3) in remaining segment 34. Fastener 65 may be any fastener that may be left in a loose condition but preferably is a threaded bolt 66 having a jam nut 67 threaded upon the terminal end 68 thereof after passing end 68 through slot 35 and hole 36 in remaining segment 34. Washers may also be placed on fastener 65 bearing against the exterior surfaces 46, 48 of remaining segments 33, 34 respectively. Remaining segments 33, 34 also have a rounded nose 29 to remove the square sharp ends of remaining segments 33, 34 to minimize damage to vehicles impacting free end 18. Though crossing gate arm assembly 10 may be constructed entirely of extruded box beams as hereinbefore recited, preferably, tubular end member 11 comprises two separate U-shaped channels 37,38 wherein the legs 43, 44 of a smaller of the U-shaped channel 38 are confined within the legs 41, 42 of a larger of the U-shaped channels 37.

Referring now to the preferred embodiment of tubular end member 11 as shown in FIG. 3, separate U-shaped channels 37, 38 are substantially identical, larger U-shaped channel 37 having legs 41, 42 of substantially the same length extending away from a broad face plate 39. Face plate 39 preferably has alternating broad red and white reflective stripes 49 applied upon the exterior surface 46 thereof, though these stripes 49 are not visible in this figure. Smaller U-shaped channel 38 is slightly smaller in width such that the exterior surfaces 53, 54 of legs 43, 44 are frictionally engaged with interior surfaces 55, 56 of legs 41, 42 of larger U-shaped channel 37. Thus, external width 52 of smaller U-shaped channel 38 is substantially the same as interior width 51 of larger U-shaped channel 37. In this manner, legs 43, 44 of smaller U-shaped channel 38 are only frictionally confined within the legs 41, 42 of larger U-shaped channel 37 wherein smaller U-shaped channel 38 may move longitudinally and/or torsionally with respect to larger U-shaped channel 37 thus making preferred tubular end member 11 torsionally flexible to withstand high wind loads when deployed in either raised storage position 40 or lowered guarding position 45. By making smaller U-shaped channel 38 of tubular end member 11 flexible with respect to larger U-shaped channel 37, crossing gate arm assembly 10 of the instant invention overcomes a major disadvantage of breakage in higher wind conditions prevalent in prior art crossing gate arm assemblies. Additionally, by providing for a flexible free end 18 of outboard tubular member 11, crossing gate arm assembly 10 also overcomes another disadvantage of breakage when impacted by a vehicle attempting to circumvent crossing gate arm assembly 10 as is common with prior art crossing gate arm assemblies. Referring still to FIG. 3, parts 17 are removed from legs 41, 42 of free end 18 of larger U-shaped channel 37 respectively leaving only a remaining segment 33 of face plate 39. As remaining segment 33 has no supporting leg 41, 42, it is transversely flexible from an inboard end 58, shown as a dashed line from cut 57 through legs 41, 42, to an outboard end 61. Free end 18' of smaller U-shaped channel 38 is similarly constructed having parts 17, removed from each of legs 43, 44 from cut 57 at inboard end 59 to outboard end 62 leaving only remaining segment 34 of face plate 47. Thus, free end 18' of smaller U-shaped channel 38 is flexible transverse to the plane of face plate 47. Outboard ends 61, 62 are preferably rounded leaving a rounded nose 29 thereon. As legs 41, 42, 43 and 44 are frictionally affixed together as hereinbefore described and free ends 18, 18' of U-shaped channels 37, 38 are subject to impact by vehicles attempting to circumvent guarding position 45, U-shaped channels 37, 38 could be further separated on impact by a vehicle if left in an unconstrained condition. Therefore, it is preferable that remaining segments 33, 34 be brought together into close proximity and loosely constrained near outboard ends 61, 62 as shown in FIG. 4, to keep U-shaped channels 37, 38 from being accidently separated. Thus, hole 36 is provided through remaining segment 34 at or near the center point 63 of a radius describing rounded nose 29, hole 36 receiving fastener 65 therein. Slot 35 is provided in remaining segment 33 of larger U-shaped channel 37, slot 35 aligned vertically with hole 36, slot 35 having its center disposed at or near a center point 64 of a radius describing rounded nose 29 of remaining segment 33 with slot 35 extending from center point 64 longitudinally along remaining segment 33 in both directions to provide for approximately a 45 degree bend of remaining segments 33, 34 in either direction transverse to the plane 30 of movement of crossing gate arm assembly 10 when fastener 65 is loosely provided through hole 36 and slot 35.

In an alternate embodiment, tubular end member 11 comprises two U-shaped channels 37, 38 of identical size having legs 41, 42 of U-shaped channel 37 overlapping legs 43, 44 of U-shaped channel 38 wherein legs 41, 43 and 42, 44 respectively, are rigidly affixed together with welds, bolts, screws, rivets or the like. Parts 17, 17' are removed as described above to provide for flexibility to free ends 18, 18' wherein remaining segments 33, 34 of free ends 18, 18' are brought together and loosely constrained with a fastener 65. By constructing tubular end member 11 from 16 gage sheet metal, the weight of tubular end member 11 is reduced from approximately 21 pounds to 6.5 pounds thus greatly reducing the entire weight of crossing gate arm assembly 10. Whether constructed by frictionally constraining one smaller U-shaped channel 38 within a slightly larger U-shaped channel 37 as previously described or by making U-shaped channels 37, 38 the same size and rigidly affixing the U-shaped channels 37, 38 together, the total shipping weight of an entire crossing gate arm assembly 10 comprising three tubular metal extendable members 11, 15 and 16 and one insulating member 14 is reduced to 55 pounds and thus can be readily shipped by rapid transit carriers. Furthermore, by constructing outboard or end member 11 in opposing U-shaped channels 37, 38 from 16 gauge sheet metal, free end 18 of tubular end member 11 of a fully extended crossing gate arm assembly 10 rides about 12 inches higher above the roadway as the total cantilevered weight of crossing gate arm assembly 10 has been significantly reduced. By so constructing end member 11, removal of weight from end member 11 further has the advantage of reducing the rotational mass of crossing gate arm assembly 10 thus reducing wear upon crossing gate operating mechanism 20. Thus it is readily apparent that crossing gate arm assembly 10 having reduced weight end member 11 is an improvement over all prior art gate arm assemblies.

Figure 2:
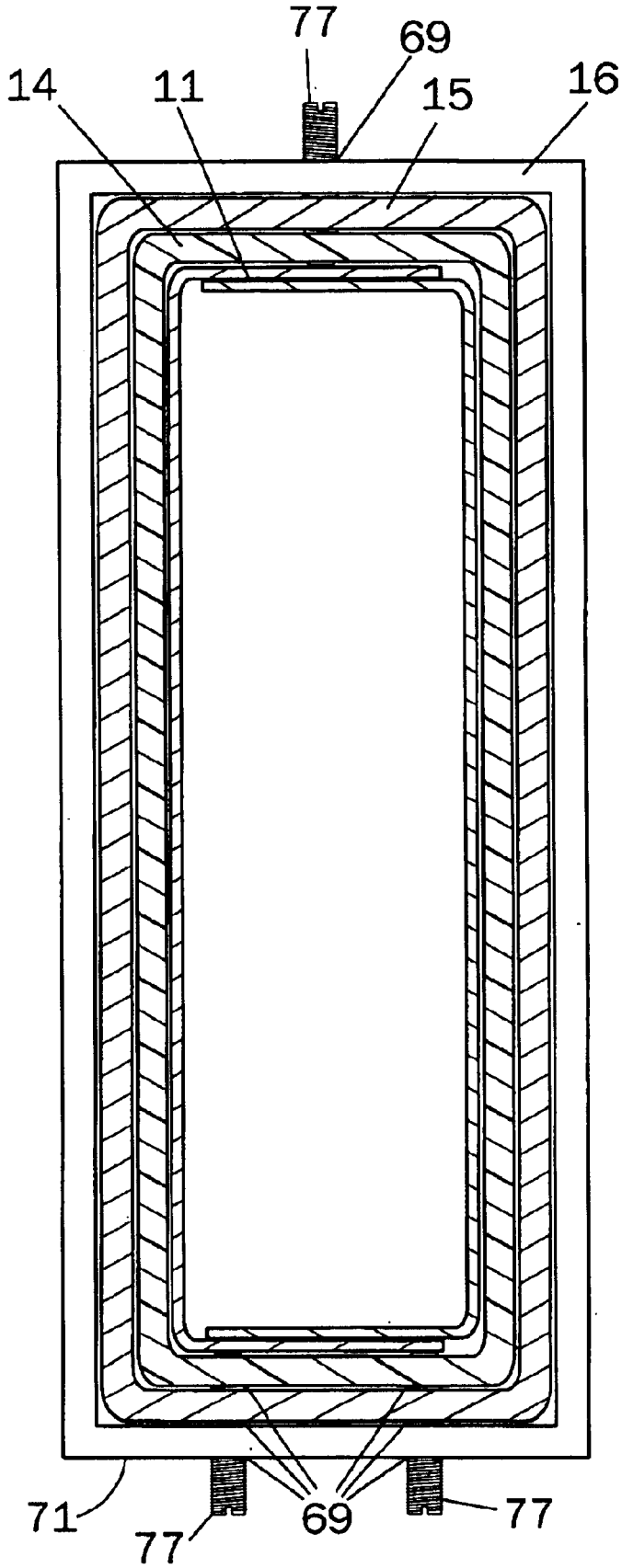
FIG. 2 is a cross section of the preferred embodiment through three tubular member of the crossing gate arm assembly telescopically received within a tubular mounting member showing the telescoping relationship of all the tubular members.

Referring now to FIGS. 1, 2 and 4, crossing gate arm assembly 10 is adapted to be rotatably mounted on crossing gate operating mechanism 20, wherein crossing gate operating mechanism 20 moves crossing gate arm assembly 10 in a plane 30 of movement from raised storage position 40 to a substantially horizontal guarding position 45. Crossing gate arm assembly 10 comprises at least three generally tubular members 11, 14–16 of substantially equal length but progressively smaller cross section wherein tubular outboard or end member 11 has one end 12 telescopically engaged within at least a portion 13 of insulating member 14. Insulating member 14 also preferably has first end 19 telescopically engaged within at least end portion 21 of alternate mounting member 15 which has base end 22 preferably installed within at least a portion of open end 23 of primary mounting member 16. Tubular member 16 has set screw holes 69 provided through the bottom wall 71 thereof near the terminal end 78 of open end 23 and a tapped hole 69 through top wall 72 spaced inwardly from terminal end 78 approximately 9 inches wherein set screws 77 are adapted to be placed in each of set screw holes 69 to secure alternate mounting member 15 to primary mounting member 16. Preferably, set screws 77 are placed in set screw holes 69 in bottom wall 71 of primary mounting member 16 and securely tightened against bottom wall 73 of alternate mounting member 15 and a set screw 77 is then threaded into tapped hole 69 in top wall 72 and driven fully into engagement with top wall 74 of alternate mounting member 15 thus binding alternate mounting member 15 within the confines of primary mounting member 16. By driving set screw 77 filly against top wall 74 after tightening set screws 77 previously placed in set screw holes 69 in bottom wall 71, alternate mounting member 15 is tipped upwardly slightly to intentionally elevate terminal end 79 thus compensating for the weight of additional members 14 and 11. In like manner, alternate mounting member 15 has set screw holes 69 provided through the bottom wall 73 thereof near the terminal end 79 of end portion 21 and a tapped hole 69 through top wall 74 spaced inwardly from terminal end 79 approximately 9 inches. Set screws 77 are placed in all set screw holes 69 in alternate mounting member 15 and insulating member 14 is slightly elevated by first tightening set screws 77 provided through bottom wall 73 against bottom surface 75 of insulating member 14 and thereafter fully tightening set screw 77 against top wall 76. End member 11 is then inserted into portion 13 of insulating member 14 and secured therein with a bolt 83 passed through matching holes 81 and 82 disposed through ends 80 and 12 of insulating member 14 and end member 11 respectively. As tubular end member 11 closely fits within portion 13 of insulating member 14, free end 18 of end member 11 is tipped upward slightly by the elevation of terminal ends 79 and 80 of alternate mounting member 15 and insulating member 14 respectively. End member 11 has been provided with flexible free end 18 and end, insulating, alternate mounting and primary mounting members 11, 14–16 are longitudinally extendable and affixable together in any length from the length of one of members 11, 14–16 plus the length of free end 18 to a fully extended length equal to the sum of the lengths of end, insulating, alternate mounting and primary mounting members 11, 14–16, less the overlapping engaged portions 12, 13 of end and insulating members 11, 14 respectively, engaged end portions 19, 21 of insulating and alternate mounting members 14, 15 respectively and engaged portions 22, 23 of alternate mounting and primary mounting members 15, 16 respectively. By tipping up terminal ends 78, 79 of primary mounting and alternate mounting members 16, 15 respectively at assembly of crossing gate arm assembly 10 to crossing gate operating mechanism 20 and providing for a reduced weight of crossing gate arm assembly 10, it is apparent that free end 18 of end member 11 will be disposed at and remain at an elevated height above the roadway surface as compared to prior art crossing gate arm assemblies.

Figure 5:
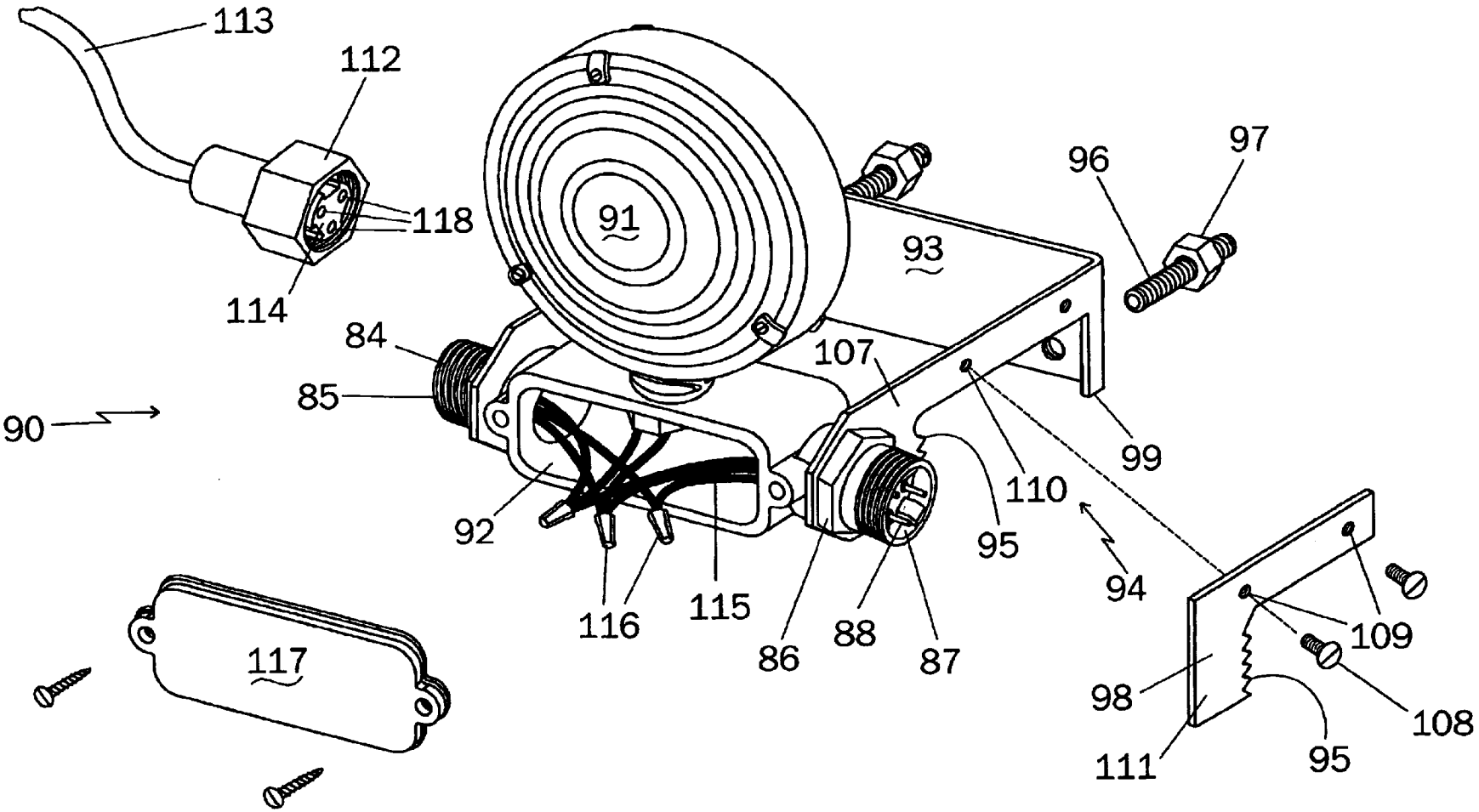
FIG. 5 is a partially exploded perspective view of one of the warning light assemblies for the crossing gate arm assembly of FIG. 1.

Crossing gate arm assembly 10 preferably has at least one warning light assembly 90 removably affixed to end member 11 and at least one warning light assembly 90 removably affixed to at least one other member 14–16. Referring now to FIG. 5, warning light assembly 90 comprises a standard warning light lens 91 mounted to a junction box 92 with junction box 92 mounted to a U-shaped bracket 93. U-shaped bracket 93 has a slot 94 disposed in the lower surface 99 of the opposed legs thereof wherein warning light assembly 90 may be lowered over upper narrow side edge 32 of end or outboard member 11 or over top walls 76, 74, 72 of insulating, alternate mounting and primary mounting members 14–16 respectively. When mounted on top of top walls 72 and/or 74 of primary mounting and alternate mounting members 16, 15 respectively, the entire width of slot 94 is utilized with elongated set screws 96 being driven into engagement with one face 101 of primary mounting member 16 or one face 103 of alternate mounting member 15 while teeth 95 disposed on an edge of slot 94 are brought into engagement with the opposite face 102, 104 respectively. As the width of narrow side edge 32 and top wall 76 of end or insulating members 11, 14 respectively is less than the width of top wall 72 and top wall 74 of primary or alternate mounting members 16, 15, respectively, when warning light assembly 90 is to be fixed to end or insulating member 11, 14, an L-shaped reducing bracket 98 is affixed to both side edges of U-shaped bracket 93 though only one L-shaped bracket 98 to be attached to one side 107 of one leg is shown in FIG. 5. Screws 108 are disposed through holes 109 in L-shaped bracket 98 and screwed into threaded holes 10 in U-shaped bracket 93. L-shaped bracket 98 has teeth 95 disposed on one leg 111 thereof which, when screwed to bracket 93, L-shaped bracket 98 reduces the width of slot 94. Warning light assembly 90 may be affixed to each of tubular members 11, 14–16 and arranged in a flashing sequence as established by railroad standards. Preferably, warning light assembly 90 has a commercially available universal reversing connector 84 affixed to each end of junction box 92 wherein reversing connector 84 has a threaded exterior 85 and an interior socket 87. Threaded exterior 85 of each reversing connector 84 mounted to junction box 92 is affixed to U-shaped bracket 93 by threading a tightening nut 86 thereon and securing tightening nut 86 against side 107. Threaded exterior 85 also receives a female nut 112 of an electrical cable 113 having a matching male reversible plug 114 which can be arranged within socket 87 in any one of three positions wherein electrical pins 88 are connected to a lighting bulb within lighting lens 91 and are adapted to be received in electrical socket holes 118 in male plug 14. By providing reversible connectors on both ends of electrical cable 113 adapted to mate with sockets 87 and warning light assemblies 90 with universal mounting brackets 93, rapid installation of warning lighting assemblies 90 may be accomplished in the field with the proper flashing sequence established by rotating male plug 114 within socket 87. Furthermore, as warning light assembly 90 has reversible connector 84 on opposed ends thereof, a plurality of light flashing sequences may be established by rotating male plug 114 to another position within socket 87. There is no need to provide for different internal wiring of warning light assemblies 90 as changing of the flashing sequence is readily made by rotating male plug 114 within socket 87.

Alternately, one warning light assembly 90 may be affixed to end member 11 by mounting warning light assembly 90 on remaining segment 33 or 34 of free end 18, 18' as at least one of remaining segments 33, 34 has holes 119 disposed therethrough for receiving screws 96 therein. Where warning light assembly 90 is mounted on one of remaining segments 33, 34, jam nuts 97 are removed from screws 96 and after disposing screws 96 though holes 119, jam nuts 97 are tightened against the exterior surface 46, 48 of remaining segment 33 or 34 upon which warning light assembly 90 has been mounted. When mounted in holes 119, slot 94 and hence teeth 95 of slot 94 or teeth 95 of L-shaped bracket 98 are not engaged with either surface 46, 48.

Larger U-shaped channel 37 of end member 11 of the preferred embodiment is formed from a length of 16 gauge sheet metal by first blanking out a length 8 feet 6 inches in length by 6 inches in width while simultaneously forming rounded nose 29 and removing parts 17 with the blanking die. Parts 17 are 16 inches in length by 1 inch in width thus leaving remaining segment 33 sixteen inches in length and 4 inches wide. A 2 inch radius is formed on outboard end 61 for rounded nose 29. Legs 41, 42 may be formed in a progressive die associated with the blanking die or one leg 41 may be separately formed on a brake by bending leg 41 one inch wide at ninety degrees away from exterior surface 46 of face plate 39, thus forming leg 41 from the juncture of cut 57 and remaining segment 33. Leg 42 may be similarly formed in a brake by also bending leg 42 one inch wide at ninety degrees away from surface 46 of face plate 39 extending in the same direction as leg 41. Slot 35 and hole 82 are also preferably formed in the progressive die while cutting away parts 17 and forming rounded nose 29 but slot 35 may be cut into remaining segment 33 and/or hole 82 formed in open end 12 in a separate operation by punching, drilling or milling. Smaller U-shaped channel 38 is formed in a like manner from a 5 13/16 wide sheet of 16 gauge sheet metal though smaller U-shaped channel 38 has legs 43, 44 formed 15/16 inch in width away from face plate 47 and face plate 47 formed 3 7/8 inches in width with hole 36 disposed at center point 63 of a radius forming rounded nose 29. Hole 36 and hole 82 are similarly formed in the progressive die while cutting away parts 17' and forming rounded nose 29 but hole 36 may be cut into remaining segment 34 and/or hole 82 formed in open end 12 in a separate operation by punching, drilling or milling. Exterior surfaces 46, 48 have adhesive backed broad retro-reflective red and white stripes 49 applied thereto except on end 12 that is inserted into portion 13 of insulating member 14 wherein a continuation of a mating red or white stripe 49 is applied to external face 105 of insulating member 14. Smaller U-shaped channel 38 is then frictionally fitted into larger U-shaped channel 37 with holes 82 aligned and hole 36 aligned with slot 35. A fastener 65 is disposed through slot 35 and hole 36, fastener 65 tightened against external surfaces 46, 48 bringing together remaining segments 33, 34 into close proximity. Fastener 65 is preferably a 5/16-18 UNC plated bolt 66 with plated 7/8 inch diameter washers disposed against exterior surfaces 46, 48. A 5/16-18 UNC plated jam nut 67 is threaded on a terminal end 68 of bolt 66 but not tightened fully against the washers thus enabling remaining segment 33 to move relative to remaining segment 34. Wire way holes and drain holes (not shown) may then be disposed into and through legs 41, 43 and/or 42, 44 after these legs are joined.

Insulating member 14 is preferably formed by cutting an 8 foot 6 inch long section of extruded or pultruded resin filled fiberglass rectangular tube having a wall thickness of 1/8 inch and inside dimensions of 1 3/16 by 4 1/16 inches. Insulating member 14 has adhesive backed broad retro-reflective red and white stripes 49 applied to external faces 105, 106 except at first end 19 which is to be fitted into receiving end portion 21 of alternate mounting member 15. A single hole 81 is centrally located in external faces 105, 106 and drilled through insulating member 14 at a distance of 3 inches from terminal end 80 for receiving bolt 83 therethrough when assembling to end member 11.

Alternate mounting member 15 is an 8 foot 6 inch long aluminum extruded tube having a 3/32 inch wall with inside dimensions of 1½ by 4 3/8 inches. Thus, alternate mounting member 15 is just slightly larger in internal dimensions than the exterior dimensions of insulating member 14 and just slightly smaller in external dimensions than the internal dimensions of primary mounting member 16. Mounting holes 27 are provided on base end 22 of alternate mounting member 15 for mounting directly to crossing gate operating mechanism 20. Set screw holes 69 are drilled and tapped into bottom and top walls 73, 74 respectively, with two rows of set screw holes 69 disposed into bottom wall 73 adjacent terminal end 79. A single set screw hole 69 is provided in top wall 74 spaced inwardly from terminal end 79 approximately 9 inches. Set screw holes 69 with set screws 77 therein provide for slightly tilting insulating member 14 upwardly when tightened thereagainst. Short tubular member 25 is identical in cross sectional size and shape as alternate mounting member 15, however, is cut only 3 feet long. Set screw holes 69 are disposed into short tubular member 25 from one end in the same manner as recited for end portion 21 of alternate mounting member 15 though alternate mounting member 15 does not have alternating broad retro-reflective stripes 49 applied thereto.

Primary mounting member 16 is also an 8 foot 6 inch long square aluminum extruded tube of 1/8 inch wall thickness and inside dimensions of 1¾ by 4 9/16 inches. Mounting holes 27 are provided on mounting end 24 for attaching primary mounting member 16 to crossing gate operating mechanism 20. Set screw holes 69 are arranged in open end 23 in the same pattern as in end portion 21 of alternate mounting member 15. Alternating broad retro-reflective stripes 49 are disposed on faces 101, 102, 103 and 104 of primary mounting and alternate mounting members 16, 15 respectively.

Warning light assembly 90 comprises a standard DOT IP P2 ST 85 dual lens flashing light 91 screwed into a top socket hole in a standard Carlon 4 inch by 1½ inch junction box 92. Junction box 92 has two other threaded holes on opposed ends both threaded holes receiving a reversible female connector 84 therein, each female connector 84 having three male electrical pins 88 wired to a bulb within light 91. U-shaped bracket 93 is formed by blanking a 1½ inch wide, 1/8 inch thick aluminum strap 12¾ inches in length. U-shaped bracket 93 has 2 inch wide slot 94 simultaneously formed during the blanking, slot 94 extending from 1½ inches from each end to 3½ inches. Teeth 95 are provided on the edge of slot 94 disposed at 1½ inches from each end. U-shaped bracket 93 is then formed into a U-shape by bending each end 90 degrees inwardly at a distance of 3 7/8 inches from each end. U-shaped bracket 93 is affixed to the opposed ends of junction box 92 with female connector 84 when threaded into the opposed ends of junction box 92. L-shaped reducing bracket 98 is blanked from 2¼ inch long, flat ⅛ thick 1½ inch wide aluminum stock and has teeth 95 disposed on the short arm. L-shaped reducing bracket 98 also has holes 109 disposed through the long arm of the L for attaching L-shaped reducing bracket 98 to U-shaped bracket 93. 1¼ inch long set screws 96 are installed in tapped holes in the flat portion for tightening U-shaped bracket 93 against one of members 11, 14–16.

Though junction box 92 may have mating reversible connectors 84, 114 at the ends of junction box 92, it is within the scope of this invention to provide grommet connectors in the place thereof for receiving the open terminal ends of a cable 113 therein wherein the open terminal ends comprise internal wiring 115 within junction box 92. Internal wiring 115 is then connected in a conventional manner with connectors 116 to provide for proper light flashing sequences. Cover plate 117 is screwed onjunction box 92 to seal internal wiring 115 therewithin.

While the present invention has been described with reference to the above described preferred embodiments and alternate embodiments, it should be noted that various other embodiments and modifications may be made without departing from the spirit of the invention. Therefore, the embodiments described and the appended drawings are merely illustrative of the features of the invention and should not be construed to be the only variants thereof.

What is claimed is:

1. In a crossing gate arm assembly rotatably mounted on a crossing gate operating mechanism, said crossing gate operating mechanism moving said crossing gate arm assembly in a plane of movement from a raised, substantially vertical storage position to a lowered substantially horizontal guarding position, the improvement wherein said crossing gate arm assembly comprises a plurality of generally tubular members, wherein the generally tubular end member has one end telescopically engagable within and affixed to at least a portion of at least one other generally tubular member, said end tubular member having both narrow side edges of a free end removed inwardly a minor distance thus leaving only a remaining segment of face plates to impart flexibility to said free end transverse to said plane of movement to prevent damage to said crossing gate arm.

2. A crossing gate arm as in claim 1 comprising three generally tubular members wherein said tubular members are substantially equal in length.

3. A crossing gate arm as in claim 2 wherein said length permits storage of said crossing gate arm in a minimum size wayside control house.

4. A crossing gate arm as in claim 2 wherein said length permits cartage of said crossing gate arm in the bed of a pickup.

5. A crossing gate arm as in claim 3 wherein said length is approximately eight feet six inches.

6. A crossing gate arm as in claim 1 wherein said part removed from both narrow side edges of said free end greatly reduces the weight of said end tubular member, thus greatly reducing the entire weight of said crossing gate arm assembly therefore reducing the rotational mass of said crossing gate arm assembly providing for reduced wear upon said crossing gate operating mechanism.

7. A crossing gate arm as in claim 1 wherein said end tubular member is rectangular in cross sections.

8. A crossing gate arm as in claim 1 wherein said end tubular member is a closed box beam.

9. A crossing gate arm as in claim 8 wherein said part comprises the narrow side edges of said box beam.

10. A crossing gate arm as in claim 1 wherein said end tubular member comprises two U-shaped channels wherein the legs of a smaller of the U-shaped channels are confined within the legs of a larger of the U-shaped channels.

11. A crossing gate arm as in claim 10 wherein said legs are frictionally affixed together.

12. A crossing gate arm as in claim 1 wherein at least one warning light assembly is removably affixed to said end tubular member and at least one warning light assembly is removably affixed to said one other tubular member.

13. A crossing gate arm as in claim 12, wherein said one warning light affixed to said end tubular member is mounted within the remaining segment of said free end.

14. A crossing gate arm as in claim 12 wherein said warning light assembly has reversible connectors on opposed sides thereof for establishing one of a plurality of light flashing sequences.

15. A crossing gate arm comprises at least one generally tubular member, wherein a generally tubular end member thereof has one end engagable within and affixed to a portion of at least one other generally tubular member and an opposite end of said generally tubular end member having a minor part of both narrow side edges of said tubular end member removed inwardly from the free end thereof leaving remaining segments without support thus imparting flexibility to said opposite end.

16. A crossing gate arm as in claim 15 wherein said end tubular member comprises two U-shaped channels wherein the legs of a smaller of said U-shaped channels are confined within the legs of a larger of said U-shaped channels wherein said smaller of said U-shaped channels may move longitudinally with respect to said larger of said U-shaped channels.

17. A crossing gate arm as in claim 16 wherein one of said U-shaped channels has a slot disposed through a remaining segment of said opposite end and the other of said U-shaped channels has a hole disposed through a remaining segment of said opposite end, said hole aligned with said slot.

18. A crossing gate arm as in claim 17 wherein a fastener is loosely placed in said slot and said hole to bring said remaining segments of said U-shaped channels into close proximity.

19. In a crossing gate arm assembly rotatably mounted on a crossing gate operating mechanism, said crossing gate operating mechanism moving said crossing gate arm assembly in a plane of movement from a raised storage position to a substantially horizontal guarding position, said crossing gate arm comprising at least three generally tubular members of substantially equal length but progressively smaller cross section wherein an end tubular member has one end telescopically engaged within and affixed to at least a portion of a generally tubular insulating member, said tubular insulating member having an end telescopically engaged within at least a portion of a generally tubular alternate mounting member, the improvement wherein said end tubular member has a flexible free end created by removing a minor part of narrow sidewalls thereof inwardly from said free end thus rendering remaining vertical walls independently flexible and wherein said end, insulating and alternate mounting tubular members are longitudinally extendable and affixable together in any length from the length of one of said members plus said free end to a fully extended length equal to the sum of the lengths of said end, insulating and alternate mounting tubular members.

* * * * *